United States Patent [19]

Manwaring

[11] 3,953,701

[45] Apr. 27, 1976

[54] RADIO FREQUENCY HEATING AND VENTILATING ELECTRODE SYSTEM

[75] Inventor: Joshua G. D. Manwaring, Needham, Mass.

[73] Assignee: Radio Frequency Co., Inc., Medfield, Mass.

[22] Filed: Mar. 24, 1975

[21] Appl. No.: 561,498

[52] U.S. Cl. ..... 219/10.81; 219/10.61

[51] Int. Cl.[2] ..... H05B 9/04

[58] Field of Search ..... 219/10.81, 10.61, 10.53, 219/10.55 F

[56] References Cited

UNITED STATES PATENTS

| | | | |
|---|---|---|---|
| 1,980,875 | 11/1934 | Nothrup | 219/10.61 X |
| 2,492,187 | 12/1949 | Rusca | 219/10.61 |
| 2,560,763 | 7/1951 | Griffith, Jr. | 219/10.81 X |

FOREIGN PATENTS OR APPLICATIONS

| | | | |
|---|---|---|---|
| 556,370 | 4/1958 | Canada | 219/10.81 |
| 946,384 | 8/1956 | Germany | 219/10.81 |
| 253,306 | 2/1948 | Switzerland | 219/10.81 |

*Primary Examiner*—Arthur T. Grimley

[57] ABSTRACT

A radio frequency heating and ventilating electrode system for treating an extended length of rod-like, electrically non-conducting material, comprising a plurality of electrically conductive hollow closed loop electrode elements, each having inwardly directed apertures therethrough, forming two series of electrode elements arranged alternately with one another along a common axis, a hollow, electrically conductive support member electrically connected to each of the two series of electrode elements, providing fluid communication thereinto, and fluid supply means connected to the support members for providing fluid flow thereto, said conductive support members being connected to a radio frequency generator to provide different polarity outputs on the two series of electrode elements for heating and ventilating rod-like, electrically non-conducting material positioned therein.

4 Claims, 2 Drawing Figures

RADIO FREQUENCY HEATING AND VENTILATING ELECTRODE SYSTEM

Figure 1:
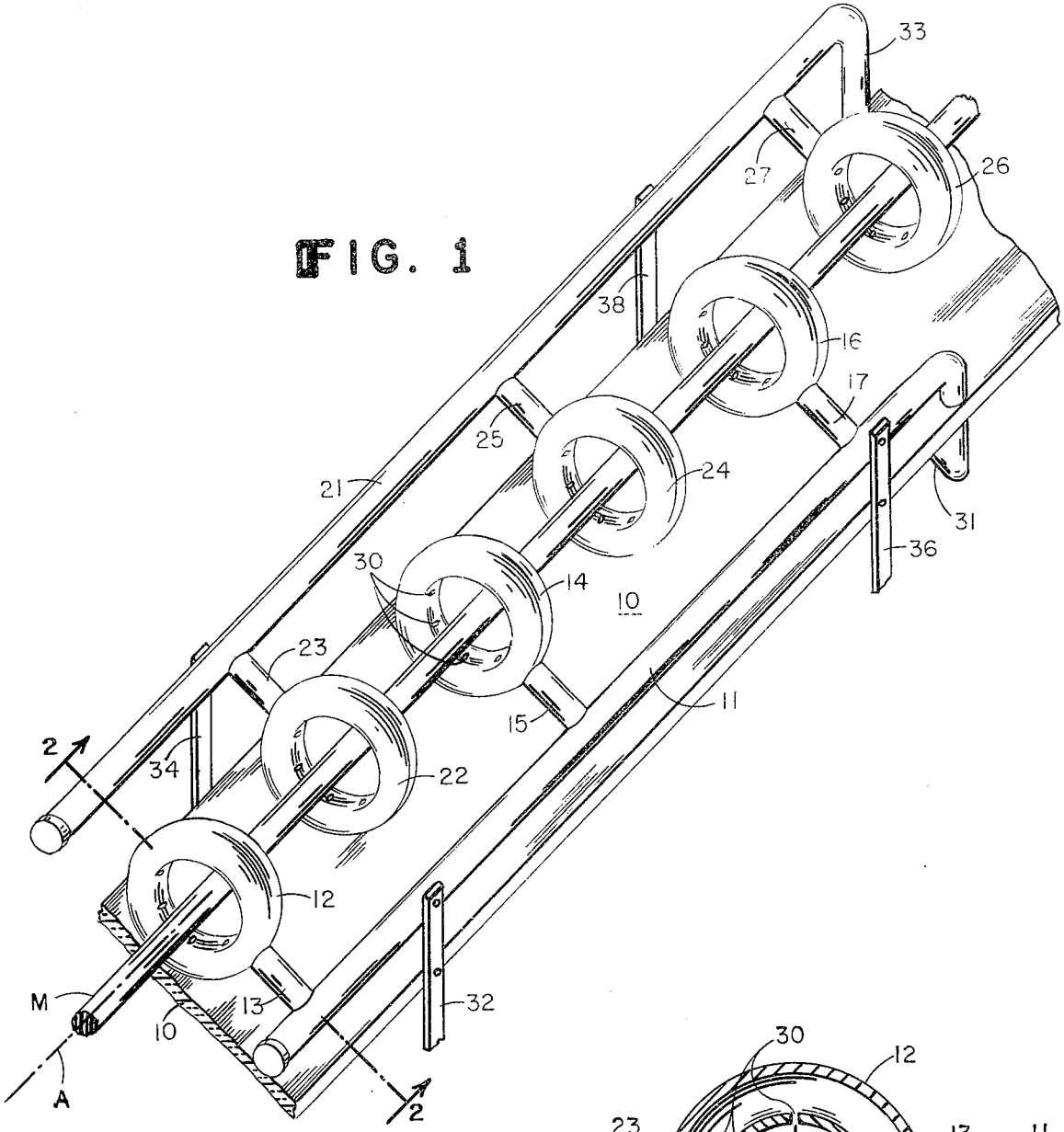

This invention relates to radio frequency heating and ventilating and, more particularly, to a novel electrode system useful therein.

Although electrode systems of the ring type for treating extended lengths of rod-like, electrically non-conducting material are known, for example, in U.S. Pat. No. 2,492,187, they are deficient in the treating of certain materials, particularly in situations wherein ventilation is required either for cooling or removing of gasses from the material being treated. However, the addition of ventilating system components to an electrode system is difficult, because of the existence of the radio frequency field which may create unwanted effects on such components.

Accordingly, it is an object of the present invention to solve this problem by providing a much simplified heating and ventilating electrode system capable of treating extended lengths of rod-like, electrically non-conducting material. It is particularly useful in connection with the apparatus of my U.S. Pat. No. 3,329,796.

The present invention accomplishes this by providing a radio frequency heating and ventilating electrode system for use with a radio frequency generator, having outputs of different polarity, for treating an extended length of rod-like, electrically non-conducting material, comprising a plurality of electrically conductive, hollow, loop, preferably ring, electrode elements each having a plurality of inwardly directed apertures therethrough. The loop elements are generally coaxial with and parallel to one another and spaced from one another in superposed relationship in a direction perpendicular to the plane of the loop electrode elements along a common axis. The loop elements form two series, arranged alternately with one another, along the common axis. Loop electrode element mounting means are provided for each of the two series of loop electrode elements, including hollow, electrically conductive support members electrically connected to each of the loop electrode elements and also providing fluid communication thereinto. Fluid supply means, such as an air blower, is connected to the support members for providing fluid flow thereto. The conductive support members are connected to different polarity outputs of the radio frequency generator to provide different polarity outputs on the two series of loop electrode elements for heating and ventilating rod-like, non-conducting material positioned along the common axis within the loop electrode elements.

In preferred embodiments, the loop electrode element mounting means may include a pair of hollow, electrically conductive support members positioned outside of the loop electrode elements on opposite sides thereof, generally parallel to one another and to the common axis, each of said pair being connected to a different one of the series of ring electrode elements and to a different polarity output of the radio frequency generator and may also include a hollow, electrically and fluid conductive connecting member extending in an outward direction from each of the loop electrode elements to one of the support members.

Figure 2:
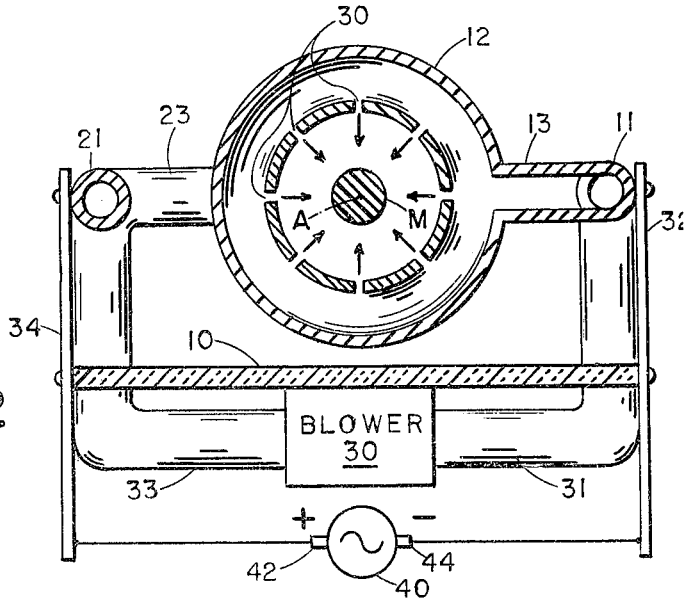

For the purpose of more fully explaining the above and still further objects and features of the invention, reference is now made to the following detailed description of a preferred embodiment thereof, together with the accompanying drawings, wherein:

FIG. 1 is a perspective view of a heating and ventilating electrode system constructed in accordance with the present invention; and FIG. 2 is a sectional view of the system of FIG. 1, taken on line 2—2 thereof.

Referring more particularly to the drawings, the heating and ventilating electrode system of the invention utilizes a plurality, herein shown for simplicity as six in number, although a greater number would normally be used, of electrically conductive, hollow, ring-shaped metallic electrode elements, 12, 14, 16, 22, 24, 26, each having a plurality of inwardly radially directed apertures 30 through their inner walls. The ring electrode elements are arranged generally coaxially with and parallel to one another and spaced from one another in superposed relationship in a direction perpendicular to the plane of the ring electrode elements along a common axis A, and, as so arranged, form two series of ring electrode elements, a first series consisting of elements 12, 14 and 16 and a second series consisting of elements 22, 24 and 26, arranged alternately with one another along said common axis.

A pair of hollow, electrically and fluid conductive tubular metallic support members 11, 21 are positioned outside of the ring electrode elements on opposite sides thereof, generally parallel to one another and to said common axis. Hollow, electrically and fluid conductive, metallic connecting members 13, 15, 17, 23, 25, 27 extend in an outward direction from electrode elements 12, 14, 16, 22, 24, 26, respectively, to one of the support members, connecting members 13, 15, 17 to support member 11 and connecting members 23, 25, 27 to connecting member 21. Both fluid and electrical communication is thus provided to each of said electrode elements through the support members and the connecting members.

The connecting members are mounted, for example, on base 10 of suitable insulating material, member 11 by conductive legs 32, 36 and member 21 by onductive legs 34, 38. The conductive support members 11, 21 are connected through legs 32, 34 to different polarity output terminals, 42, 44 of radio frequency generator 40 to provide different polarity outputs on the two series of ring electrode elements, 12, 14, 16 and 22, 24, 26, respectively.

A blower 30, connected to support members 11, 21 as by electrically non-conducting pipes 31, 33, respectively, provides air flow to each of the ring electrode elements, 12, 14, 16, 22, 24, 26.

In operation to heat and ventilate rod-like nonconducting material M, such as organic plastic material, either moving or stationary, positioned along common axis A within the two series of ring electrode elements, 12, 14, 16 and 22, 24, 26, respectively, each of said series is connected to a different polarity output, 42, 44, respectively, of radio freqency generator 40, and air is supplied by blower 30 for passage through inwardly directed apertures 30 against the material M, as shown by the arrows in FIG. 2. If desired, gasses can be removed from the vicinity of material M by reversing the direction of flow of blower 40. Other types of fluids, including both nonelectrically conductive gasses and liquids can also be used if desired.

What is claimed is:

1. A radio frequency heating and ventilating electrode system for use with a radio frequency generator having outputs of different polarity for treating an extended length of rod-like electrically non-conducting material, comprising a plurality of electrically conductive hollow loop electrode elements each having a plurality of inwardly directed apertures therethrough, said loop elements being generally coaxial with and parallel to one another and spaced from one another in superposed relationship in a direction perpendicular to the plane of said loop electrode elements along a common axis said loop electrode elements forming two series of loop electrode elements arranged alternately with one another along said common axis loop electrode element mounting means for each of said two series of loop electrode elements, including hollow, electrically conductive support members electrically connected to each of said loop electrode elements providing fluid communication thereinto, and fluid supply means connected to said support members for providing fluid flow thereto, said conductive support members being connected to different polarity outputs of said radio freqency generator to provide said different polarity outputs on said two series of ring electrode elements for heating and ventilating rod-like, electrically non-conducting material positioned along said common axis within said loop electrode elements.

2. An electrode system as claimed in claim 1, wherein:

said loop electrode element mounting means includes a pair of hollow, electrically conductive support members positioned outside of said loop electrode elements generally parallel to one another and to said common axis each of said pair being connected to a different said series of loop electrode elements and a different polarity output of said radio frequency generator.

3. An electrode system as claimed in claim 2, wherein:

said loop electrode element mounting means includes a hollow, electrically and fluid conductive connecting member extending in an outward direction from each of said loop electrode elements to one of said support members.

4. An electrode system as claimed in claim 3 wherein said loop electrode elements are in the form of rings.

* * * * *